US005307930A

United States Patent [19]

Wilk et al.

[11] Patent Number: 5,307,930

[45] Date of Patent: May 3, 1994

[54] TOOL ASSEMBLY

[76] Inventors: Marilyn M. Wilk; Peter J. Wilk, both of 185 West End Ave., New York, N.Y. 10023

[21] Appl. No.: 917,596

[22] Filed: Jul. 23, 1992

[51] Int. Cl.[5] ..... E03D 9/00; B65D 81/36

[52] U.S. Cl. ..... 206/349; 4/255.11; 81/490

[58] Field of Search ..... 4/255.02, 255.03, 255.05, 4/255.07, 255.11, 255.12; 81/490; 206/15.2, 15.3, 349, 361; 312/42, 45, 206; 401/109, 112, 113, 117

[56] References Cited

U.S. PATENT DOCUMENTS

| | | | |
|---|---|---|---|
| 470,777 | 3/1892 | Billings | 81/490 |
| 1,244,798 | 10/1917 | Tharp et al. | 401/117 |
| 1,701,771 | 2/1929 | Stefano | 401/109 |
| 2,233,157 | 2/1941 | Cahn et al. | 206/361 |
| 4,211,750 | 7/1980 | Gillespie | 206/361 |
| 4,432,451 | 2/1984 | Hooser . | |
| 4,776,456 | 10/1988 | Lewis . | |
| 4,922,555 | 5/1990 | Bonilla et al. . | |
| 4,991,987 | 2/1991 | Holloway et al. | 401/117 |
| 5,040,679 | 8/1991 | Rehmann . | |
| 5,048,989 | 9/1991 | Stageman | 401/109 |
| 5,114,006 | 5/1992 | Wilk | 206/349 |

FOREIGN PATENT DOCUMENTS

| | | | |
|---|---|---|---|
| 622195 | 6/1961 | Canada . | |
| 611145 | 5/1979 | Switzerland . | |
| 0450916 | 7/1936 | United Kingdom | 401/109 |
| 658710 | 10/1951 | United Kingdom . | |

*Primary Examiner*—Jimmy G. Foster
*Attorney, Agent, or Firm*—R. Neil Sudol; Henry D. Coleman

[57] ABSTRACT

A household implement comprises a tool member including an operative element and a rod attached at one end to the operative element. The tool member is slidably mounted to a hollow housing having an opening at one end (a lower end) and a hand grip at an opposite end (an upper end). The tool member shifts relative to the housing between a retracted position inside the housing and an extended position wherein the operative element and a portion of the rod are outside of the housing. A locking element(s) is provided for locking the tool member in the extended position.

13 Claims, 2 Drawing Sheets

TOOL ASSEMBLY

BACKGROUND OF THE INVENTION

This invention relates to a tool assembly. More particularly, this invention relates to an assembly for a household implement such as a bathroom plunger.

Most households have at least one bathroom plunger for removing blockages in drains. Frequently, particularly in those houses having limited storage space or in those houses having pronounced drainage difficulties, plungers sit in open view, beneath the sink or beside the bathtub. Generally, because of their functional design, plungers are not especially pleasant to view. Accordingly, it would be useful to enclose the plunger in an appropriately sized housing, by which means the plunger would still remain easily accessible for immediate use in case of emergency.

Plungers are also unsanitary implements, inasmuch as little care is generally taken to clean them. Such implements are therefore a source of disease bacteria for young children who inhabit floor spaces and are not adverse to intimate tactile association with whatever objects are on the floor.

Objects of the Invention

An object of the present invention is to provide a household implement such as a plunger or brush device with a housing for hiding the implement from view.

Another, more particular object of the present invention is to provide such a plunger or brush device with a housing having any of a variety of decorative shapes.

Another object of the present invention is to provide a tool assembly, for use as a household implement such as a bathroom plunger, wherein a housing or casing also serves as a holder.

Yet another object of the present invention is to provide such a tool assembly which serves to maintain sanitary conditions and to prevent young children from playing with household implements which may carry infectious bacteria or viruses.

These and other objects of the invention shall be apparent from the detailed descriptions and illustrations hereof.

SUMMARY OF THE INVENTION

A household implement comprises, in accordance with the present invention, a tool member including an operative element and a rod attached at one end to the operative element. The tool member is slidably mounted to a hollow housing having an opening at one end (a lower end) and a hand grip at an opposite end (an upper end). The tool member shifts relative to the housing between a retracted position inside the housing and an extended position wherein the operative element and a portion of the rod are outside of the housing. A locking element(s) is provided for locking the tool member in the extended position.

Pursuant to another feature of the present invention, the tool member is mounted to the housing via a bar connected to the rod at an end thereof opposite the operative element. The bar extends orthogonally to the rod and traverses a pair of longitudinally extending slots in the housing. Preferably, the slots are on opposite sides of the housing and the bar is straight.

According to another feature of the present invention, the locking elements include a pair of side or auxiliary slots communicating with respective longitudinally extending slots at the one or lower end of the housing. The side slots may take the specific form of circumferential extensions of the longitudinal slots.

Pursuant to a further feature of the present invention, one or more additional locking elements are provided for locking the tool member in the retracted position. The additional locking elements may also include a pair of side or auxiliary slots communicating with respective longitudinally extending slots at the opposite or upper end of the housing.

According to yet another feature of the present invention, the bar has a rectangular cross-section. This feature facilitates locking of the tool member relative to the housing. The edges of the bar provide torque against undesired turning of the tool member relative to the housing.

According to a supplemental feature of the invention, the housing includes a transversely oriented plate at the opposite or upper end of the housing, the hand grip including a pair of parallel elongate slots in the plate.

A method for executing a household chore comprises, in accordance with the present invention, the steps of (a) lifting up a housing by a handle provided at an upper end thereof, (b) extending, from an opening in a lower end of the housing, a tool member disposed inside the housing prior to the step of lifting, (c) rotating the tool member with respect to the housing, thereby locking the tool member in an extended position to the housing, (d) manipulating the housing and the tool member via the handle to perform a task to which the tool member is adapted, (e) again rotating the tool member with respect to the housing upon completion of the task, thereby unlocking the tool member from the housing, (f) retracting the tool member back into the housing, and (g) placing the housing upon a horizontal surface so that the opening is covered and the tool member is again contained inside the housing.

According to another feature of the present invention, the method also comprises the step of rotating the tool member with respect to the housing prior to extension of the tool member from the housing. Preferably, the rotation of the tool member relative to the housing prior to the extension of the tool member from the housing is executed when the housing is lifted a small distance from a horizontal surface, whereby friction may be utilized to maintain the tool member in a relatively stationary position during a manual twisting of the housing.

A tool assembly in accordance with the present invention is particularly useful where the tool member comprises a plunger or a toilet brush. The housing encloses the plunger or brush and hides that implement from view when it is not being used. When the plunger or brush is to be used, however, the housing or casing becomes an element of the handle and the hand grip for the implement. Accordingly, the length of the handle is effectively doubled by having the housing or casing also serve as a part of the handle (the extension serving as the other part of the handle).

A tool assembly in accordance with the present invention, when used as a plunger or toilet brush design, is also useful to maintain sanitary conditions and to prevent young children from playing with such implements. A locking device may be provided on the housing or casing for purposes of denying access to the implements to young children.

DETAILED DESCRIPTION

Figure 1:
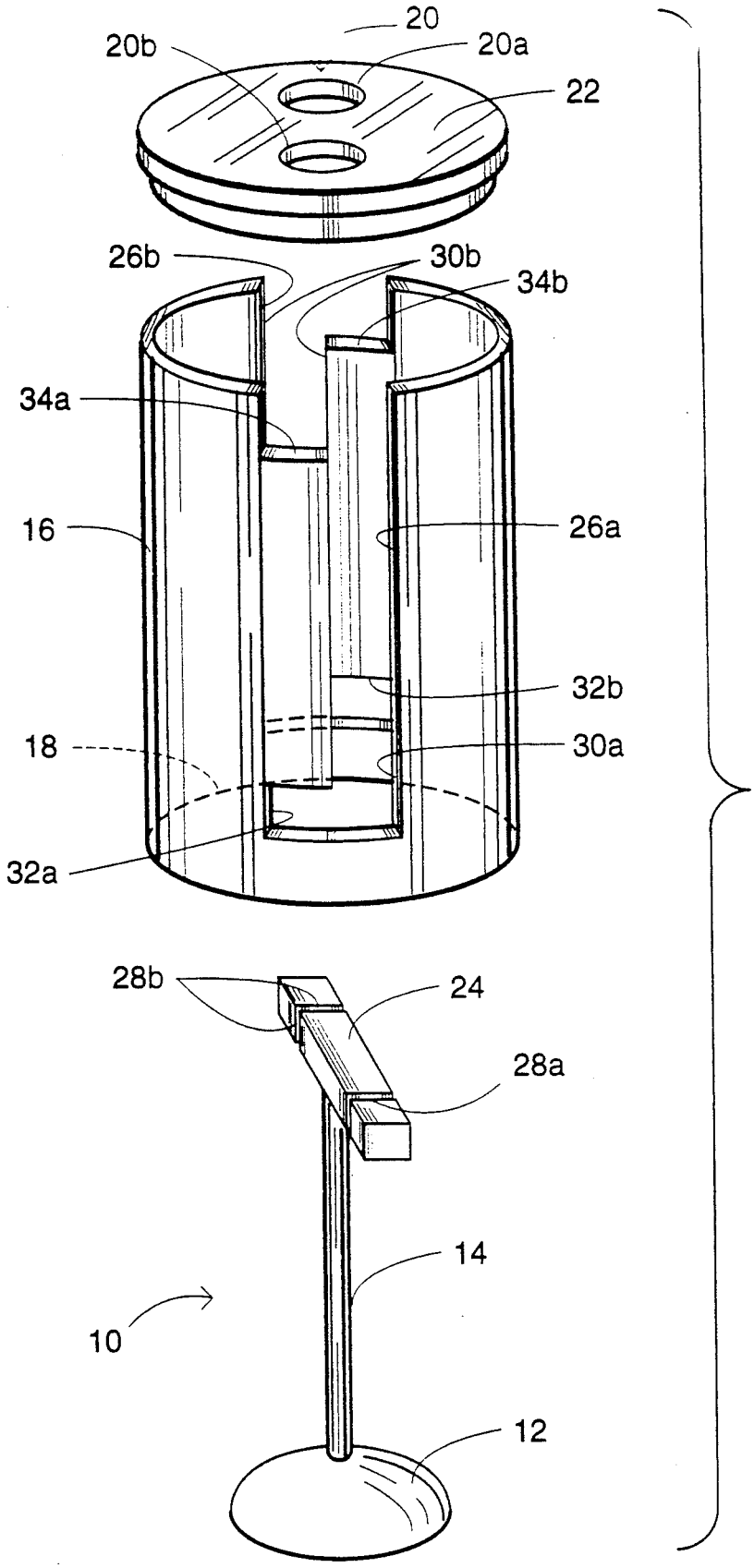
FIG. 1 is a schematic exploded perspective view of a plunger and casing assembly in accordance with the present invention.

As illustrated in FIG. 1, a household implement comprises a tool member 10 specifically including an operative element 12 in the form of a cup-shaped resilient plunger head and an elongate rod 14 attached at one end to plunger head 12. Tool member 10 is slidably mounted to a hollow housing 16 having an opening 18 at a lower end and a hand grip 20 at an upper end. Hand grip 20 comprises a pair of rounded parallel slots 20*a* and 20*b* disposed in a cover plate 22 attached to housing 16 at the upper end thereof.

Tool member 10 shifts or reciprocates relative to housing 16 between a retracted position inside housing 16 (FIGS. 2A and 2B) and an extended position (FIG. 2D) wherein plunger head 12 and a portion of rod 14 are outside of housing 16. To that end, rod 14 is provided at an upper end, opposite plunger head 12, with a transversely extending and cross-sectionally rectangular bar or elongate flange 24, while housing 16 is provided with a pair of longitudinally extending slots 26*a* and 26*b* traversed by bar 24. During reciprocation or shifting of tool member 10 relative to housing 16, bar 24 slides along slots 26*a* and 26*b*. To prevent rotation of tool member 10 about a transverse axis during longitudinal or axial reciprocation of the tool member relative to housing 16, bar 24 may be provided along its sides with grooves 28*a* and 28*b* into which edges 30*a* and 30*b* of slots 26*a* and 26*b* fit.

Slots 26*a* and 26*b* are provided at lower ends with oppositely extending circumferential extensions or side slots 32*a* and 32*b* and at upper ends with additional oppositely extending circumferential extensions of side slots 34*a* and 34*b*. Lower circumferental extensions 32*a* and 32*b* communicate with longitudinally extending slots 26*a* and 26*b* for providing a means for locking tool member 10 in the extended position shown in FIG. 2D, thereby facilitating use of the tool member 10 to unclog a toilet bowl or drain. Upper circumferential extensions 34*a* and 34*b* similarly communicate with longitudinally extending slots 26*a* and 26*b* for providing a means for locking tool member 10 in the retracted position shown in FIGS. 2A and 2B, thereby permitting housing 16 to be lifted and carried to another location while maintaining tool member 10 in the retracted position inside the housing.

The rectangular cross-section of bar 24 facilitates locking of tool member 10 relative to housing 16 The edges of bar 24 provide torque against undesired turning of tool member 10 relative to housing 16.

Figure 2A:
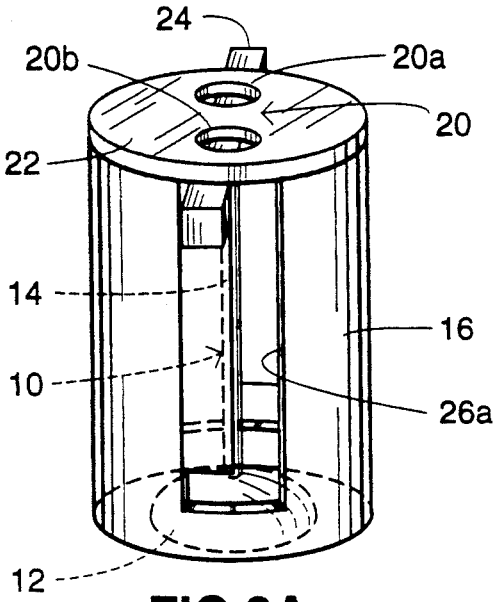
FIGS. 2A–2D are schematic perspective views of the plunger and casing assembly of FIG. 1 in an assembled configuration, showing successive stages in the use of the assembly.
Figure 2B:
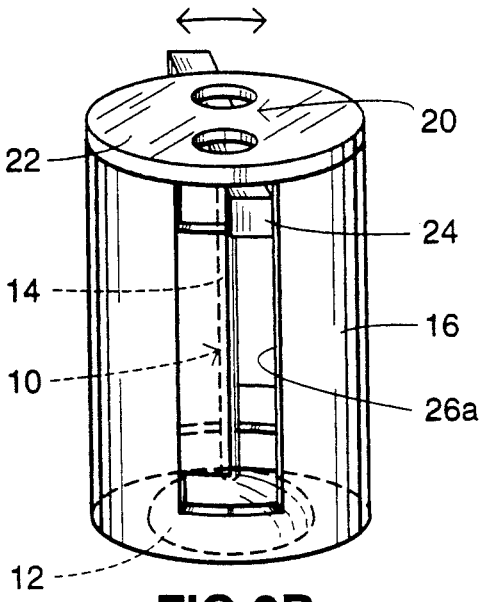

FIG. 2A shows the household implement of FIG. 1 in an assembled, storage configuration. To use the implement, housing 16 is grasped via handle or hand grip 20. Housing 16 is then lifted slightly off of the floor so that it no longer rests on the floor and so that plunger head 12 remains resting on the floor surface. A torque is then applied to housing 16 via hand grip 20 to turn housing 16 relative to tool member 10. Tool member 10 remains stationary relative to the floor surface but rotates relative to housing 16, whereby bar 24 is brought out of the upper circumferential slot extensions 34*a* and 34*b* into the upper ends of longitudinal slots 26*a* and 26*b*, as illustrated in FIG. 2B. It is to be noted that upper circumferential slot extensions 34*a* and 34*b* are sufficiently wider than bar 24, in the axial or vertical direction, to permit an elevation of housing 16 without a frictional engagement between bar 24 and edges of slot extensions 34*a* and 34*b*.

Figure 2C:
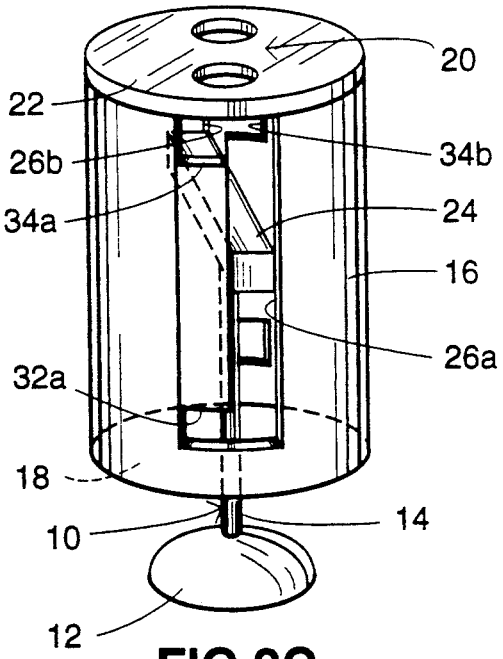
Figure 2D:
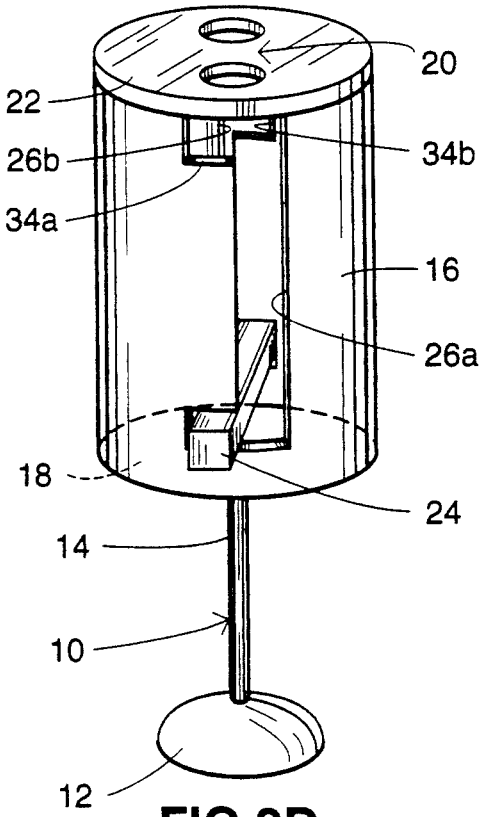

Upon a rotation of housing 16 and tool member 10 relative to one another, as depicted in FIG. 2B, hand grip 20 is used to further lift housing 16 relative to tool member 10. While housing 16 is raised, plunger head 12 remains resting on the floor surface while bar 24 slides down longitudinal slots 26*a* and 26*b*. From opening 18 in housing 16, tool member 10 emerges, plunger head 12 first, as illustrated in FIG. 2C. Upon a completed extension of tool member 10 relative to housing 16, i.e., upon the reaching of the bottoms of slots 26*a* and 26*b* by bar 24, plunger housing 16 is again twisted so that the free ends of bar 24 enter lower circumferential slot extensions 32*a* and 32*b*, as illustrated in FIG. 2D, thereby locking tool member 10 in an extended position to housing 16. Housing 16 and tool member 10 are then manipulated via hand grip or handle 20 to clear a drain or toilet bowl. Subsequently, plunger head 20 is placed into contact with a floor surface and the above-described steps are repeated in reverse in order to bring tool member 10 again into a retracted position inside housing 16. It is to be noted that during the entire operation, it is not necessary to touch tool member 10. Only hand grip 20 need be grasped.

Although the invention has been described in terms of particular embodiments and applications, one of ordinary skill in the art, in light of this teaching, can generate additional embodiments and modifications without departing from the spirit of or exceeding the scope of the claimed invention. For example, tool member 10 may be locked to housing 16 in the retracted or the extended position by other equivalent means such as a spring loaded pin or detent.

Accordingly, it is to be understood that the drawings and descriptions herein are preferred by way of example to facilitate comprehension of the invention and should not be construed to limit the scope thereof.

What is claimed is:

1. A household implement comprising:

a tool member including an operative element and a rod attached at one end to said operative element;

a hollow housing having an opening at one end and a hand grip at an opposite end, said housing includes a transversely oriented plate at said opposite end of said housing, said hand grip including a pair of parallel elongate slots in said plate;

mounting means for mounting said tool member to said housing for slidable motion between a retracted position inside said housing and an extended position wherein said operative element and a portion of said rod are outside of said housing; and locking means on said housing for locking said tool member in said extended position.

2. The implement defined in claim 1 wherein said mounting means includes a bar connected to said rod at an end thereof opposite said operative element, said bar extending orthogonally to said rod, said mounting means further including a pair of longitudinally extending slots in said housing, said bar traversing said slots.

3. The implement defined in claim 2 wherein said locking means includes a pair of side slots communicating with respective ones of said longitudinally extending slots at said one end of said housing.

4. The implement defined in claim 3, further comprising additional locking means on said housing for locking said tool member in said retracted position.

5. The implement defined in claim 4 wherein said additional locking means includes a pair of said slots communicating with respective ones of said longitudinally extending slots at said opposite end of said housing.

6. The implement defined in claim 5 wherein said bar has a rectangular cross-section.

7. The implement defined in claim 1, further comprising additional locking means for locking said tool member in said retracted position.

8. The implement defined in claim 7 wherein said additional locking means includes a pair of side slots communicating with respective ones of said longitudinally extending slots at said opposite end of said housing.

9. The implement defined in claim 1 wherein said locking means includes a pair of side slots communicating with respective ones of said longitudinally extending slots at said one end of said housing.

10. The implement defined in claim 1 wherein said tool member is a plunger and said operative element is a cup-shaped resilient member.

11. A method for executing a household chore, comprising the steps of:

lifting up a housing by a handle provided at an upper end thereof;

extending, from an opening in a lower end of said housing, a tool member disposed inside said housing prior to said step of lifting;

rotating said tool member with respect to said housing, thereby locking said tool member in an extended position to said housing;

manipulating said housing and said tool member via said handle to perform a task to which said tool member is adapted;

upon completion of said task, again rotating said tool member with respect to said housing, thereby unlocking said tool member from said housing;

retracting said tool member back into said housing; and placing said housing upon a horizontal surface so that said opening is covered and said tool member is again contained inside said housing.

12. The method defined in claim 11, further comprising the step of also rotating said tool member with respect to said housing prior to said step of extending, thereby unlocking said tool member from said housing.

13. The device defined in claim 12 wherein said step of also rotating is executed when said housing is lifted a short distance from a horizontal surface, thereby using friction to maintain said tool member in a relatively stationary position during a manual twisting of said housing.

* * * * *

Disclaimer 5,307,930—Marilyn M. Wilk; Peter J. Wilk, both New York, N.Y. TOOL ASSEMBLY. Patent dated May 3, 1994. Disclaimer filed January 17, 1997, by the assignee, Wilk Patent Development Corp.

The term of this patent shall not extend beyond the expiration date of Pat. No. 5,335,374.
*(Official Gazette,* June 17, 1997)